United States Patent [19]

Nitzki

[11] 4,002,132

[45] Jan. 11, 1977

[54] CATAMARAN WITH PLURAL DRIVES

[75] Inventor: Leopold Nitzki, Bremen, Germany

[73] Assignee: Aktiengesellschaft "Weser", Bremen, Germany

[22] Filed: May 29, 1975

[21] Appl. No.: 581,964

[30] Foreign Application Priority Data

June 4, 1974 Germany ..... 2426804

[52] U.S. Cl. ..... 114/61

[51] Int. Cl.[2] ..... B63B 1/10

[58] Field of Search ..... 114/61, 57, 123

[56] References Cited

UNITED STATES PATENTS

| | | | |
|---|---|---|---|
| 906,901 | 12/1908 | Lane et al. | 114/57 |
| 3,310,019 | 3/1967 | Standridge | 114/123 XR |
| 3,675,605 | 7/1972 | Knerr | 114/61 |

FOREIGN PATENTS OR APPLICATIONS

| | | | |
|---|---|---|---|
| 805,011 | 5/1951 | Germany | 114/61 |

OTHER PUBLICATIONS

Alden D. Armagnac, "The Inside Story of Garwood's Sea Speeder," *Popular Science*, vol. 155, No. 5, Nov. 1949.

*Primary Examiner*—Trygve M. Blix
*Assistant Examiner*—Gregory W. O'Connor
*Attorney, Agent, or Firm*—Michael J. Striker

[57] ABSTRACT

A catamaran has two hulls each having longitudinal axes with reference to which the hull is asymmetrical. The hulls are located at opposite sides of a longitudinal symmetry line of the catamaran and the axes of the hulls are longitudinally inclined relative to this line, so as to diverge away from this line either in forward or in rearward direction of the catamaran. Each hull has at least one propeller shaft which extends substantially parallel to the symmetry line and which has a shaft portion projecting from the hull and located either adjacent the outwardly or inwardly facing side of the hull, where it carries a propeller.

7 Claims, 6 Drawing Figures

CATAMARAN WITH PLURAL DRIVES

BACKGROUND OF THE INVENTION

The present invention relates to watercraft in general, and to catamarans in particular. Still more specifically, the invention relates to a catamaran having plural drives.

Catamarans are dual-hull vehicles which are usually used for the transportation of freight. Since catamarans are well known, a detailed discussion of the principles of construction and operation of these watercraft is not necessary herein.

It is known to provide catamarans wherein at the rear end of each hull there is located a single propeller, and wherein the respective hulls are constructed substantially symmetrically with reference to their longitudinal axes, which in turn extend parallel to the longitudinal symmetry line of the catamaran per se. The prior-art catamarans suffer from certain disadvantages which have restricted their use despite the fact that such vessels potentially offer many advantages, particularly in the transportation of cargo. Among these disadvantages are the fact that the flow conditions of the water relative to the hulls, and in particular the water flow to the propellers, are not advantageous.

SUMMARY OF THE INVENTION

Accordingly, it is an object of the present invention to overcome the drawbacks of the prior art.

More particularly, it is an object of the present invention to provide an improved catamaran wherein the flow conditions of the water relative to the catamaran hulls are improved.

Another object of the invention is to provide such a catamaran wherein the flow conditions of the water to the propellers of the drives for the catamaran are better than what is known from the prior art.

In keeping with these objects, and with others which will become apparent hereafter, one feature of the invention resides in a catamaran that comprises two hulls each of which has a longitudinal axis with reference to which the hull is asymmetrical. The hulls are located at opposite sides of a longitudinal symmetry line of the catamaran and the axes of the hulls are longitudinally inclined relative to this line. Propulsion means is provided on the hulls for propelling the catamaran through the water.

The inclination of the longitudinal axes of the two hulls with reference to the symmetry line of the catamaran per se in effect produces a venturi effect in the channel located between the two hulls, and it has been found in tests that the resistance to movement of the catamaran through the water is significantly decreased and the efficacy of the propulsion is concomitantly increased.

Moreover, this mutual inclination of the hulls relative to one another and to the longitudinal symmetry line of the catamaran offers the possibility of arranging the propellers in the regions laterally of the hull sides, either between the huls in the channel defined by the hulls, or adjacent the outwardly facing sides of the hulls. This has the advantage that the water can flow freely and without hindrance to these laterally arranged propellers, being uniformly distributed in its flow and being able to have access to the respective propellers over 360° of arc. In other words: dead water areas, which heretofore could never be avoided, are now eliminated according to the present invention.

The propellers may either be arranged laterally of the hulls but forwardly of the rear ends thereof, or laterally of the hulls but rearwardly spaced from the rear ends thereof. Of course, each hull may be provided with additional propellers. In order to avoid disadvantageous influences of the operation of these additional propellers upon the aforementioned laterally arranged propellers, and thus to maintain and possibly even improve the advantageous water flow conditions to these laterally arranged propellers, the present invention further proposes to provide each of the hulls with an asymmetrically arranged transom stern which merges into a skeg-like guide portion provided on the respective hull. Depending upon whether the hulls diverge from the centerline forwardly or rearwardly of the catamaran, the guide portion will be located either at the outer sides or the inner sides of the hulls.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 3:
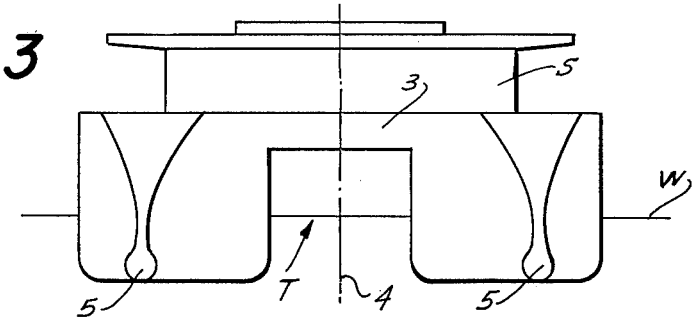
FIG. 3 is a front elevational view of FIG. 1.
Figure 1:
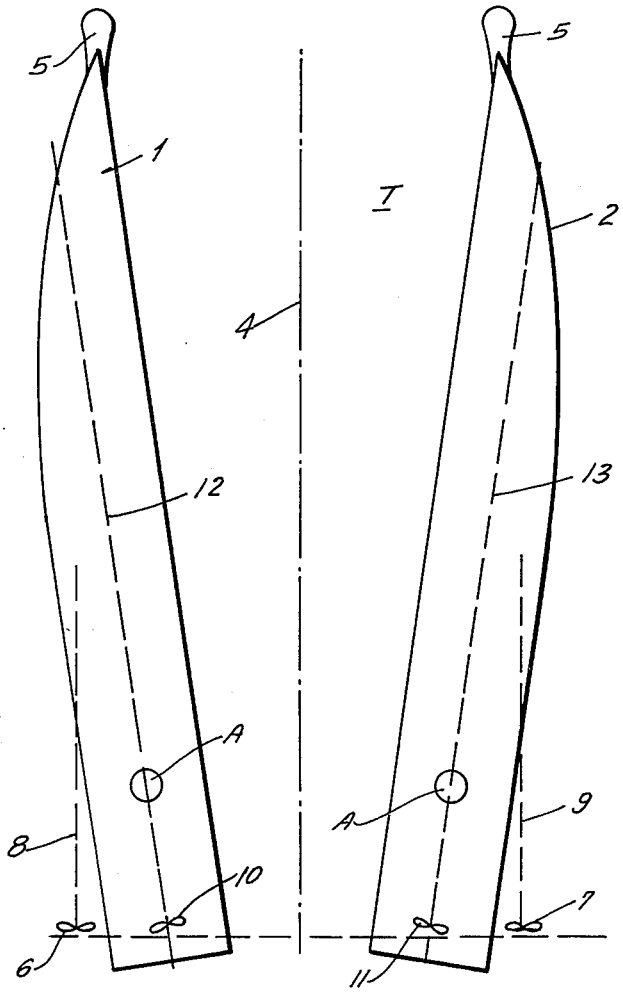
FIG. 1 is a diagrammatic illustration of a catamaran according to one embodiment of the invention showing the outline of the hulls that would be visible in a horizontal section taken at the waterline of the catamaran and below the catamaran bridge.
Figure 2:
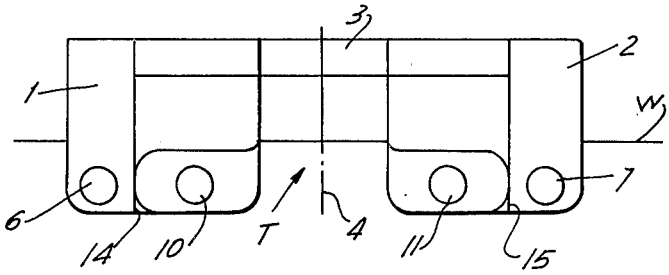
FIG. 2 is a diagrammatic rear end view of FIG. 1, with details of the catamaran bridge omitted.

In the embodiment of FIGS. 1–3, the catamaran has the hulls 1 and 2 which are located at opposite sides of a longitudinal symmetry line 4 of the catamaran. These hulls 1 and 2 are connected by the usual catamaran bridge 3. No details of the hull construction are required, because this is conventional and well known to those skilled in the art, except for the fact that each hull 1 and 2 is asymmetrical in its construction, with reference to its respective longitudinal axis 12 or 13. In this embodiment, the axes 12 and 13 are inclined with reference to the centerline 4 so that they diverge from this centerline 4 in direction towards the front end of the catamaran. In prior-art catamarans, the axes 12 and 13 would extend parallel to the centerline 4 and the hulls 1 and 2 would thus form with one another a tunnel which, unlike the tunnel T of FIGS. 1–3, would have a constant cross section from the front end to the rear end of the catamaran. The waterline profiles of the hulls 1 and 2 can be selected, depending upon the angle of inclination of the axes 12 and 13 with reference to the centerline 4, in such a manner as to assure the best water flow conditions. This can be determined by those skilled in the art without undue experimentation. The front ends of the hulls 1 and 2 are provided with bulbous bows 5 which, in known manner, also serve to advantageously influence the flow of water along the hulls.

The hulls 1 and 2 are provided with respective propulsion devices or drives. Each hull has a propeller shaft 8 and 9; these are illustrated only diagrammatically because the manner in which propeller shafts are mounted in hulls, and the manner in which they are driven, is already known in the art and present no problem to those having ordinary skill in this field. What is important, however, is that unlike the longitudinal axes 12, 13 of the hulls 1 and 2, the propeller shafts 8 and 9 extend substantially parallel to the longitudinal centerline 4 of the catamaran so that the rear end portions of the shafts 8 and 9 project through the outwardly directed sides of the hulls 1 and 2 (compare FIG. 1) and are thus located laterally of these sides. These rear end portions of the shafts 8 and 9 carry respective propellers 6 and 7 to which, due to this location, the water can flow freely and without forming any dead-water areas.

Additional propellers 10 and 11 may be provided on the hulls 1 and 2, together with their (not illustrated) propeller shafts, and these may be located centrally below and/or behind the respective rear ends of the hulls 1 and 2. The propeller shafts of all of the drives will be driven in the usual manner known to those skilled in the art, and no detailed description of suitable prime movers for this purpose is required, especially as this does not form a part of the invention.

The waterline is identified with reference character W and the superstructure carried on the catamaran bridge 3 is identified with reference character S in FIG. 3.

It will be appreciated that the invention as disclosed with reference to FIGS. 1–3 not only produces a substantially improved flow of the water along the hulls 1 and 2 and to the propellers 6, 7, thus eliminating dead-water areas, but also offers additional advantages in terms of the arrangement of the drives in the hulls 1, 2. For example, drives for the propellers 6, 7 may be located in the foreparts of the hulls 1, 2, and drives for the propellers 10 and 11 may be located in the rear parts of the hulls, so that due to this possibility of separating the drives for different propellers, it is possible to utilize available space in the hulls which previously was not sufficient to accommodate the combined drives for all propellers, but which is large enough to accommodate drives for one set of propellers. This may, for example, provide a satisfactory solution for the problem of accommodating such drives in catamarans having very slender hulls.

To assure that there is no interference with the water flow to the propellers 6, 7, and to provide for an improved flow of water to the propellers 10 and 11, the hulls 1, 2 are provided with asymmetric transom sterns which in downward direction merge to one side into a skeg-like guide portion 14, 15 for the water. In the embodiment of FIGS. 1–3, the guide portions 14, 15 are located at or towards the outwardly facing sides of the hulls 1, 2, thereby assuring that they are located intermediate the propellers 6, 7 (compare FIG. 2), thus enabling them to guide the water towards the propellers 6, 7 in such a manner that the water can flow concentrically towards them. This arrangement also improves the flow of the water to the propellers 10, 11.

Figure 6:
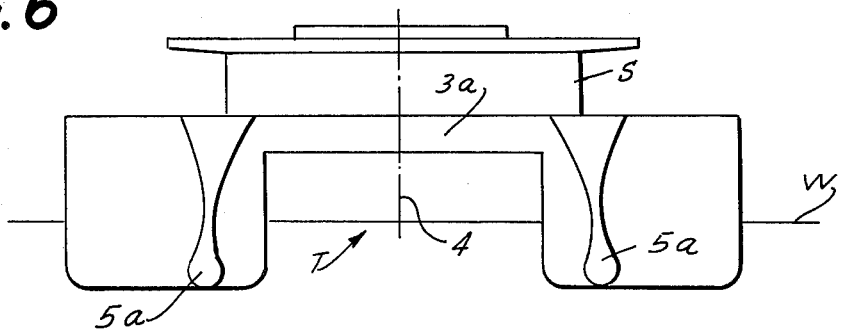
FIG. 6 is a view similar to FIG. 3, but of the embodiment in FIG. 4.
Figure 4:
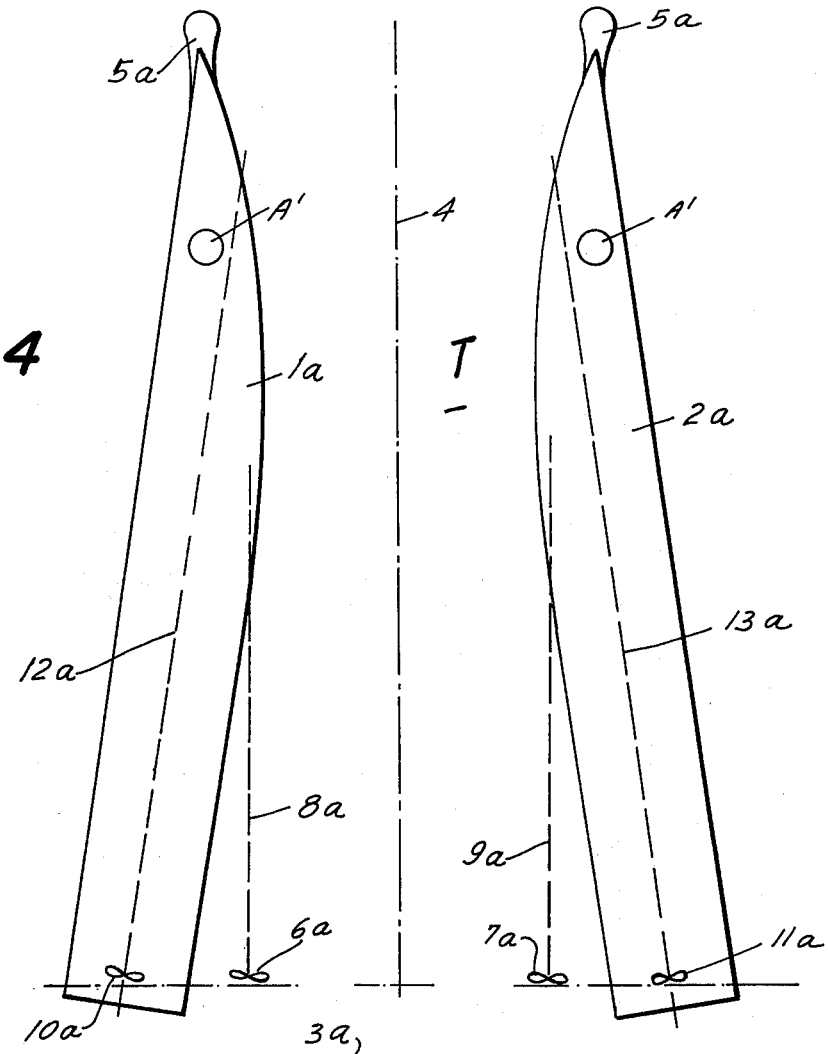
FIG. 4 is a view similar to FIG. 1, but illustrating a further embodiment of the invention.
Figure 5:
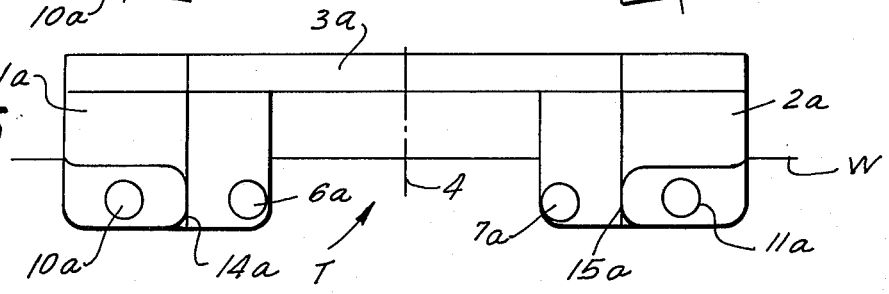
FIG. 5 is a view similar to FIG. 2, but of the embodiment in FIG. 4.

The embodiment in FIGS. 4–6 is essentially similar to that of FIGS. 1–3, and like reference numerals have been employed provided with the suffix "*a*." The difference in FIGS. 4–6 as compared to FIGS. 1–3 is that the longitudinal axes 12*a*, 13*a* of the hulls 1*a* and 2*a* are inclined with reference to the longitudinal symmetry line 4 of the catamaran so that they diverge away from the symmetry line in rearward direction, rather than in forward direction of the catamaran. As a result of this, the propeller shafts 8*a* and 9*a* penetrate through the inwardly facing sides of the hulls 1*a* and 2*a* and the propellers 6*a* and 7*a* are therefore located adjacent these inwardly facing sides, i.e., in the tunnel T between the hulls 1*a* and 2*a*. As FIG. 5 shows, it is necessary in this arrangement to have the bulbous bows 5*a* of the hulls 1*a* and 2*a* merge with the skeg-like guide portions 14*a* and 15*a* towards the inner sides of the hulls 1*a*, 2*a*, in order to obtain the desired guidance of water towards the propellers.

The most advantageous angle to be included between the axes 12, 13 and the centerline 4 in FIGS. 1–3, or between the axes 12*a*, 13*a* and the centerline 4*a* in FIGS. 4–6, can be readily empirically determined by constructing a model of the catamaran and towing it through a body of water. Such a model would have the hulls 1, 2 or 1*a*, 2*a* which would be mounted on the catamaran bridge 3 so that they could be turned about the vertical axes A or A′ (compare FIGS. 3 and 4). It goes without saying, of course, that such pivotable mounting about the axes A or A′ would not be the case in an actual full-size catamaran vessel, but would be required only in a model so that the hulls 1, 2 or 1*a*, 2*a* can be turned about the axes A or A′ during the towing of the model through the body of water, until the most advantageous angle of inclination of the longitudinal axis of the hulls with reference to the centerline of the catamaran is determined empirically. Evidently, the most advantageous configuration of the hulls 1, 2 themselves can also be determined in this manner, as is known to those skilled in the art.

It will be understood that each of the elements described above, or two or more together, may also find a useful application in other types of constructions differing from the type described above.

While the invention has been illustrated and described as embodied in a catamaran with plural drives, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A catamaran, comprising two elongated huls each having a longitudinal axis and a pair of opposite side portions laterally spaced from said longitudinal axis, said side portions being substantially parallel to each other and to said longitudinal axis over at least a part of the elongation of a respective hull, said hulls being located at opposite sides of a longitudinal symmetry line of the catamaran and the axes of said hulls being longitudinally inclined relative to said line; and propulsion means on said hulls for propelling said catamaran through the water, said propulsion means comprising for each of said hulls a propeller shaft extending substantially parallel to said longitudinal symmetry line.

2. A catamaran, comprising two elongated hulls each having a longitudinal axis and a pair of opposite side portions laterally spaced from said longitudinal axis, said side portions being substantially parallel to each other and to said longitudinal axis over at least a part of the elongation of a respective hull, said hulls being located at opposite sides of a longitudinal symmetry line of the catamaran and the axes of said hulls being longitudinally inclined relative to said line; and propulsion means on said hulls for propelling said catamaran through the water, said propulsion means comprising for each of said hulls a propeller shaft extending substantially parallel to said symmetry line and having a shaft portion projecting outwardly from and located laterally of the respective hull, and a propeller mounted on said shaft portion laterally of the associated hull.

3. A catamaran as defined in claim 2, said catamaran having a front end and a rear end; and wherein said axes of said hulls are inclined outwardly of said longitudinal symmetry line in direction towards said rear end, said hulls having inner sides facing one another and said propellers being mounted laterally of said inner sides so as to be located between said hulls.

4. A catamaran as defined in claim 3, said hulls each having an asymmetric transom stern located at said rear end of said catamaran and merging at said inner side into a skeg-like guide portion.

5. A catamaran as defined in claim 2, said catamaran having a front end and a rear end; and wherein said axes of said hulls are inclined outwardly of said centerline in direction towards said front end, said hulls having outer sides facing away from one another and said propellers being mounted laterally of said outer sides.

6. A catamaran as defined in claim 5, said hulls each having an asymmetric transom stern located at said rear end of said catamaran and merging at said outer side with a skeg-like guide portion.

7. A catamaran as defined in claim 2, wherein each hull has an asymmetrical configuration with reference to a respective longitudinal axis.

* * * * *